US005199599A

United States Patent [19]

Shade

[11] Patent Number: 5,199,599

[45] Date of Patent: Apr. 6, 1993

[54] APPARATUS FOR DISPENSING ARTICLES

[76] Inventor: Michael W. Shade, P.O. Box 33, Depere, Wis. 54115

[21] Appl. No.: 901,767

[22] Filed: Jun. 19, 1992

[51] Int. Cl.[5] ..... B65H 1/08

[52] U.S. Cl. ..... 221/226; 221/231; 221/241; 221/253; 221/285

[58] Field of Search ..... 221/151, 224, 226, 228, 221/231, 235, 237, 241, 242, 244, 245, 253, 285, 304

[56] References Cited

U.S. PATENT DOCUMENTS 1,621,960 3/1927 Stewart et al. ..... 221/304 X
2,010,373 8/1935 Pinkenburg ..... 221/241 X

FOREIGN PATENT DOCUMENTS 659146 12/1986 Switzerland .

*Primary Examiner*—Robert P. Olszewski
*Assistant Examiner*—Dean A. Reichard
*Attorney, Agent, or Firm*—Godfrey & Kahn

[57] ABSTRACT

A dispensing apparatus is disclosed for sequentially vending articles upon the movement of an actuator. The dispensing apparatus includes a housing which encloses a plurality of newspapers, and which further includes a passageway; a platform is disposed within the housing and which includes an aperture formed therein, the platform supporting the articles within the housing; a rearward support assembly is borne on the platform and operable for movement toward the passageway; a forward support assembly is borne by the housing and is operable to position an article in an appropriate orientation for viewing from a position outside the housing; a carriage assembly is borne on the platform and is operable for limited motion in the housing, and wherein movement of the forward support assembly positions the carriage assembly in a predetermined location relative to the platform; a metering assembly is mounted for pivotal movement on the carriage assembly and is operable for travel from a first position, wherein it partially occludes the platform aperture, to a second, substantially non-occluding position relative to the platform aperture: an actuator is mounted on the housing and is operable for movement from a first, non-vend position to a second, vend position; a drive assembly is disposed in force receiving relation relative to the actuator, the drive assembly is operable to simultaneously drive the rearward support assembly toward the passageway, and drive the metering assembly from the first, partially, occluding position to the second non-occluding position.

12 Claims, 10 Drawing Sheets

APPARATUS FOR DISPENSING ARTICLES

1. FIELD OF THE INVENTION

The present invention relates generally to an apparatus for dispensing articles, such as newspapers and the like, and more particularly, to a coin-operated newspaper dispensing apparatus in which the newspapers are individually and sequentially dispensed upon insertion of the proper coinage.

2. DESCRIPTION OF THE PRIOR ART

The typical street corner newspaper dispenser includes a metal box which holds a vertical stack of newspapers, and a front door which can be opened when the proper coinage is inserted thereby permitting access to the newspapers. Once the front door is opened, however, the purchaser has access to the entire stack of newspapers. It is presumed under most instances, that a purchaser has a need for only one newspaper.

Unfortunately, this system of vending newspapers is defenseless against unscrupulous individuals who, on occasion, insert the necessary coinage to obtain a single paper, but who subsequently remove the entire stack, and thereafter sell the individual papers at their own considerable profit. Moreover, and during times of unpredictable weather, such as a sudden thunderstorm, the corner newspaper dispenser often serves as an expedient umbrella dispenser whereby a single customer inserts the necessary coinage to unlock the door, however, surrounding persons take additional papers to seek immediate protection from the elements. In addition to the foregoing, newspapers are often stolen for other purposes, such as, for example, to provide an insulative lining for the clothes, or bedding for the homeless, and combustible fuel for make-shift corner heaters during the winter months. It should be understood that street corner newspaper dispensers currently suffer a loss rate of up to 40%.

The prior art is replete with assorted dispensing apparatuses and other assemblies for vending newspapers. For example, such devices include complex dispensing systems which are powered by assorted levers, biasing springs, sophisticated cam assemblies and complex gear arrangements to individually dispense single newspapers or other similar rectangular shaped, or generally parallelepiped objects. However, and while widely diverse in construction and operation, these same prior art dispensers of newspapers are also replete with a multiplicity of deficiencies and other shortcomings which have detracted from their usefulness.

Foremost among the deficiencies of prior art single vend newspaper dispensers is the daily adjustments or steps which must often occur, prior to loading the newspapers, to prepare these same dispensers for operation. More particularly, it should be understood that the thickness of a daily newspaper varies from day to day, for example, a Monday edition of a newspaper has a thickness dimension which is invariably less than a Sunday edition which normally contains a variety of weekly magazines, television guides, and numerous coupons. Due, of course, to the wide range of thicknesses in which newspapers may be published and because these prior art dispensers lack a convenient means for quickly accommodating newspapers having these assorted thicknesses, newspaper delivery personnel are often confronted with the time-consuming and aggravating task of individually adjusting or preparing numerous newspaper dispensers for that day's edition. For example, U.S. Pat. No. 3,960,291 teaches that newspapers must be painstakingly oriented within the dispensing machine in an overlapping and alternating arrangement. Additionally, U.S. Pat. No. 4,008,828 teaches that the newspaper dispenser must be manually adjusted for each daily newspaper edition which is placed therein, and such adjustment is accomplished by manipulating a nut and lever assembly. As should be readily apparent, these manual adjustments, and preparations unduly delays the delivery of newspapers which results in cost increases, and employee frustration and fatigue.

The prior art also discloses numerous devices and assemblies for addressing the aforementioned problems. Pertinent prior art references include, but are not limited to, U.S. Pat. Nos. 4,139,120; 4,174,047; and 4,258,861 to name but a few.

Another deficiency of the prior art dispensing machines is that they are typically quite complex in design which correspondingly significantly increases the likelihood that these dispensing machines will fail, jam, or otherwise experience malfunction during operation in the outside environment which will include being subjected to the elements, and which further may include harsh physical treatment from the typical consumer and delivery person. Moreover, the complex design of these prior art dispensing machines obviously increases the attendant manufacturing and maintenance costs for these same devices.

Yet another deficiency with the prior art newspaper vending dispensers relates to the difficulty of reading the display copy of the newspaper. More particularly, a typical newspaper dispensing machine includes a transparent front door which is low to the ground, and which is substantially vertically oriented such that a potential purchaser of a newspaper must bend down to an awkward position to look in the door and read the headlines of the display copy. This results in undue consumer inconvenience.

Therefore, it has long been known that it would be desirable to have a newspaper vending apparatus that dispenses one issue of a newspaper, or the like, at a time, is simple, efficient, and durable in design, and which further addresses the deficiencies attendant with the prior art devices, and practices.

OBJECTS AND SUMMARY OF THE INVENTION

Therefore, it is an object of the present invention to provide an improved apparatus for dispensing articles, such as newspapers and the like.

Another object of the present invention is to provide such an apparatus which is operable to obtain the individual benefits to be derived from related prior art apparatuses and practices while avoiding the detriments individually associated therewith.

Another object of the present invention is to provide an apparatus for dispensing articles such as newspapers, magazines and other articles of similar shape, and which is simple in construction, reliable in operation, and which further effectively inhibits or substantially impedes the unauthorized removal of the individual newspapers without a corresponding payment.

Another object of the present invention is to provide an apparatus for dispensing articles which is free of problematic mechanical arrangements and which further includes simple and inexpensive subassemblies, and which additionally is manually operated.

It is a further object of the present invention to provide an apparatus for dispensing articles, such as newspapers, which employs a simple, reliable, but nevertheless accurate and efficient adjustment assembly for reliably and sequentially dispensing newspapers of different thicknesses.

A further object of the present invention is to provide an apparatus for dispensing articles, such as newspapers, which does not damage, tear, rip or otherwise perforate the individual newspapers during vending thereof.

A further object of the present invention is to provide such an apparatus for dispensing articles which is easily assembled and constructed of inexpensive subassemblies, and which further has a rugged, long lasting, relatively damage proof construction.

A further object of the present invention is to provide an apparatus for dispensing articles, such as newspapers, which does not require newspaper stack alteration or reconfiguration, and which further does not require other preparation of the newspapers prior to their being loaded into the apparatus.

Another object of the present invention is to provide an apparatus for dispensing articles such as newspapers and the like and which permits a customer to easily view a display copy thereof.

Another object of the present invention is to provide an apparatus which substantially eliminates pilferage or theft of the articles by dishonest customers.

Yet another object of the present invention is to provide a single-vend article dispenser for newspapers, and the like, and which will support a large number of newspapers so as to be competitive with non-single vend machines which are utilized for substantially identical purposes.

Further objects and advantages of the present invention are to provide improved elements and arrangements thereof in an apparatus for the purposes described which is dependable, economical, durable and fully effective in accomplishing its intended purposes.

These and other objects and advantages are achieved in an apparatus for dispensing articles such as newspapers and the like and which includes a housing which encloses the newspapers, the housing having a passageway which permits individual newspapers to exit the housing; a platform disposed within the housing, the platform including a major axis and a minor axis oriented perpendicular thereto, the platform having an aperture formed therein, and wherein the platform is operable for supporting the newspapers within the housing; a rearward support assembly mounted for movement along a first path of travel, the rearward support assembly being operable to urge the newspapers toward the passageway; a forward support assembly mounted on the platform and operable to position a newspaper in an appropriate orientation for viewing from a position outside the housing; a carriage assembly slidably mounted within the housing and operable for movement along a predetermined, second path of travel, the carriage assembly mounted on the forward support assembly, and wherein the movement of the forward support assembly positions the carriage assembly in a predetermined location along the second path of travel; a metering assembly mounted for pivotal movement on the carriage assembly and operable for movement along a third path of travel, from a first position, wherein the metering assembly is disposed in partially occluding relation relative to the platform aperture whereby it substantially inhibits forward movement of the newspapers relative to the passageway, to a second position, wherein the metering assembly is disposed in a substantially non-occluding position relative to the platform aperture thereby permitting the newspapers to move in the direction of the passageway; an actuator mounted on the housing and which is operable for movement along a fourth path of travel from a first, non-vend position, to a second, vend position; and a drive assembly disposed in force receiving relation relative to the actuator, and which is operable to simultaneously drive the metering assembly, along the third path of travel, from the first, partially occluding position, to the second, non-occluding position, and drive the rearward support assembly toward the passageway.

DETAILED DESCRIPTION OF THE PREFERRED EMBODIMENT

Figure 2:
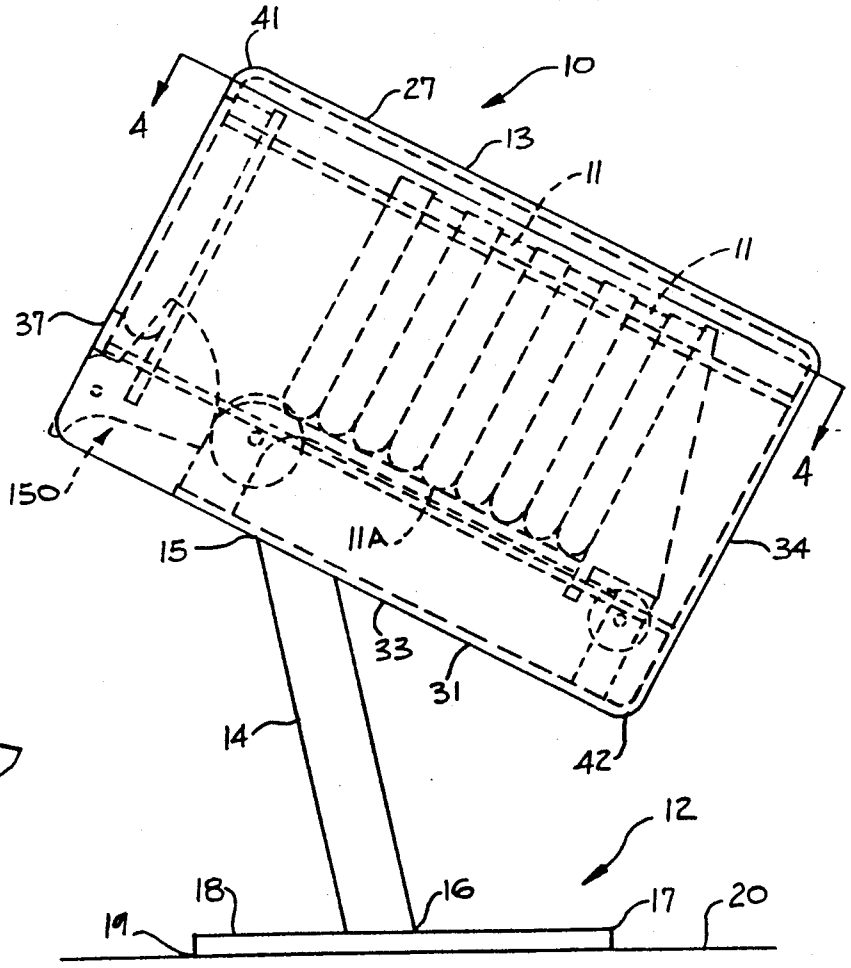
FIG. 2 is a right side elevational view of the apparatus of the subject invention shown in FIG. 1 with some underlying structures shown in phantom lines.
Figure 1:
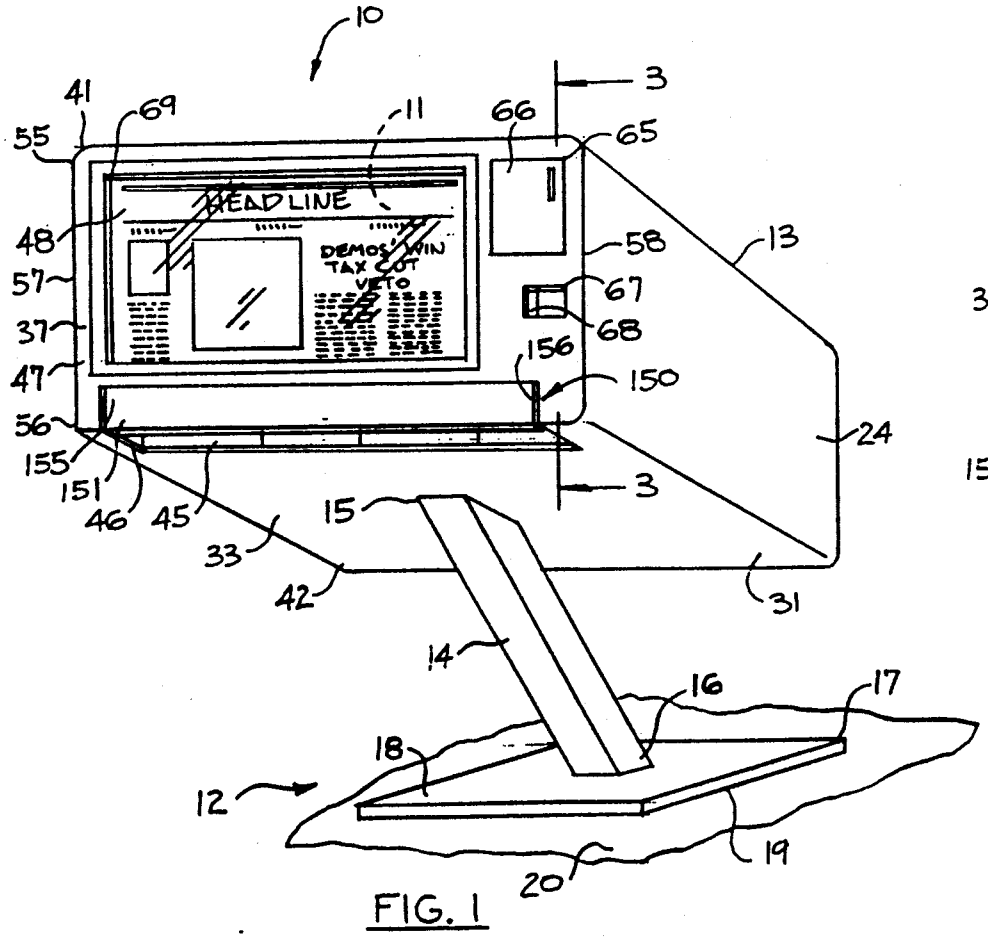
FIG. 1 is a perspective, environmental view of the apparatus of the subject invention shown in a typical operative configuration.

Referring more particularly to the drawings, the apparatus of the subject invention is generally indicated by the numeral 10 in FIGS. 1 and 2. As shown therein, the apparatus 10 is operable to enclose and dispense a plurality of articles, one at a time, such as newspapers 11, magazines, or similar substantially identically shaped objects.

The newspapers 11 are individually defined by predetermined length, width and thickness dimensions and further include a folded edge portion 11A. As best illustrated, in FIGS. 1 and 2, the apparatus includes a support assembly which is generally indicated by the numeral 12, and a housing 13. The support assembly includes a post member 14 having a first end 15 and a second end 16; and a platform member 17 having a top surface 18 and bottom surface 19. The first end 15 is made integral with the housing, and the second end 16 is made integral with the top surface 18 of the platform member. The joint between the first end 1 and the housing will be described in further detail hereinafter. Further, the bottom surface 19 of the platform member is disposed in resting engagement on the surface of the earth 20 thereby supporting the housing in an appropriate orientation for operation.

As best illustrated by reference to FIGS. 3 and 4, the housing 13 is substantially rectangularly shaped, and is defined by a left panel 21 having an interior facing surface 22 and an exterior facing surface 23; a right panel 24 having an interior facing surface 25 and an exterior facing surface 26; a roof panel 27 having an interior facing surface 28 and an exterior facing surface 29; a floor panel 31 having an interior facing surface 32 and an exterior facing surface 33; a rear panel 34 having an interior facing surface 35 and an exterior facing surface 36; and a door or display assembly 37 having an interior facing surface 38 and an exterior facing surface 39. A housing cavity, and which is generally indicated by the numeral 40, within which the newspapers 11 are enclosed, is defined by the interior facing surfaces 22, 25, 28, 32, 35, and 38, respectively. Further, the housing 13 has a forward portion 41 and a rearward portion 42.

Figure 5:
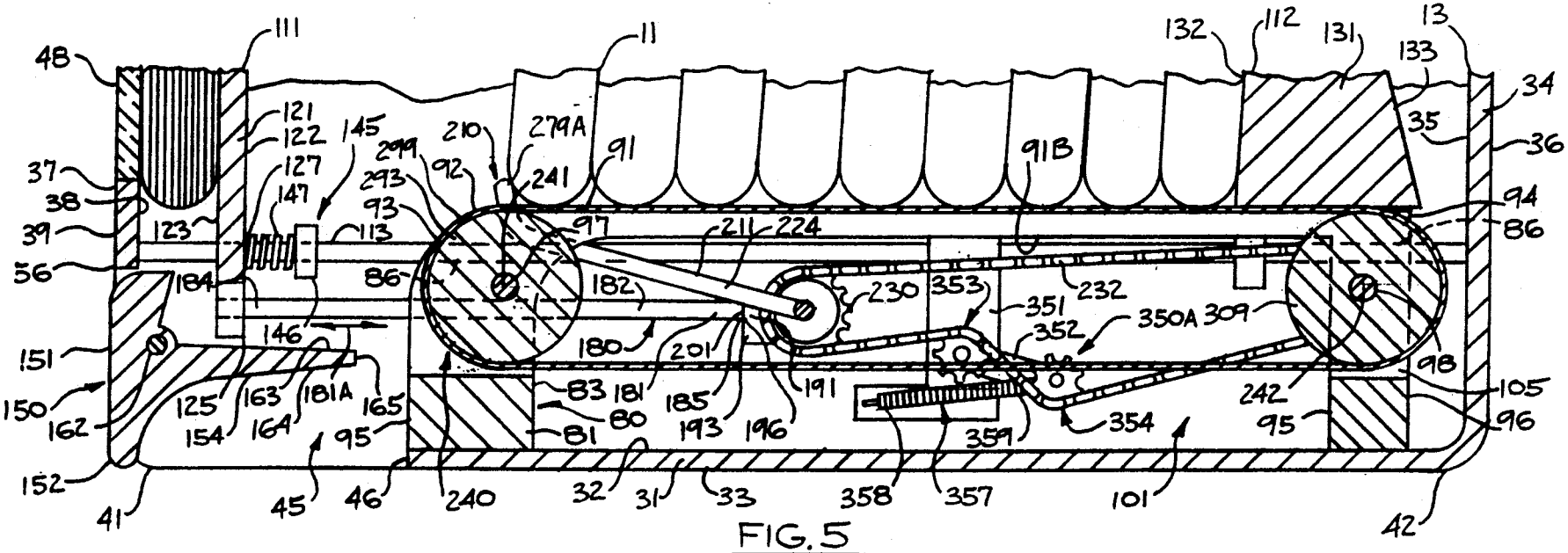
FIG. 5 is a fragmentary, vertical, sectional view of the apparatus of the subject invention which is taken from a position along line 5—5 of FIG. 4.
Figure 6:
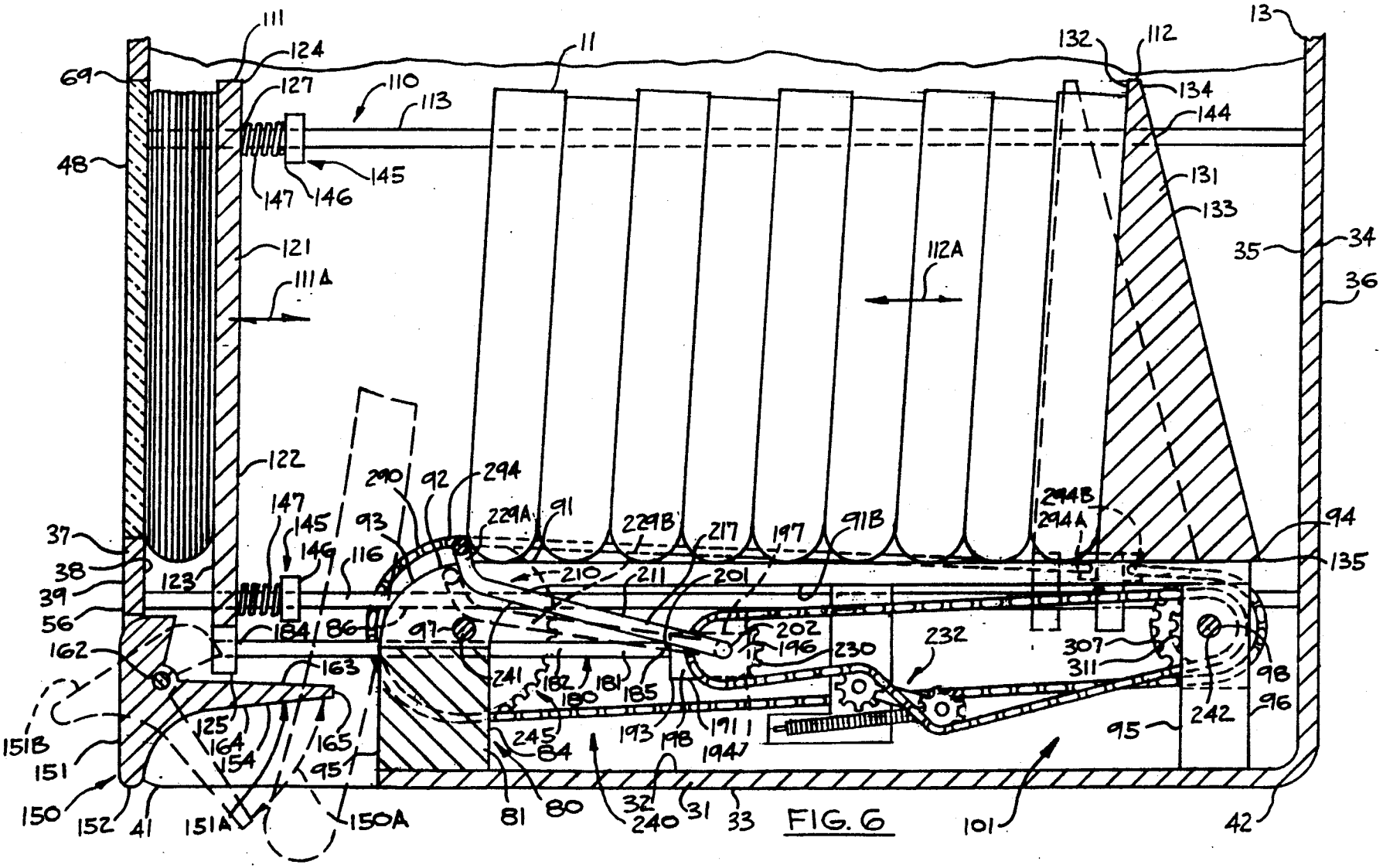
FIG. 6 is a fragmentary, vertical, sectional view of the apparatus of the subject invention taken from a position along line 6—6 of FIG. 4.

As best seen by reference to FIG. 1 and FIG. 5, the floor panel 31 has formed therein a passageway 45 which is substantially rectangularly shaped and which is defined by a peripheral edge 46. As should be understood, the passageway 45 is defined by a length dimension which is greater than the width of the newspaper 11, and is further defined by a width dimension which is greater than the thickness dimension of the newspaper thereby permitting individual newspapers to exit or pass from the housing cavity 40 to the outside environment during operation of the apparatus 10.

Figure 3:
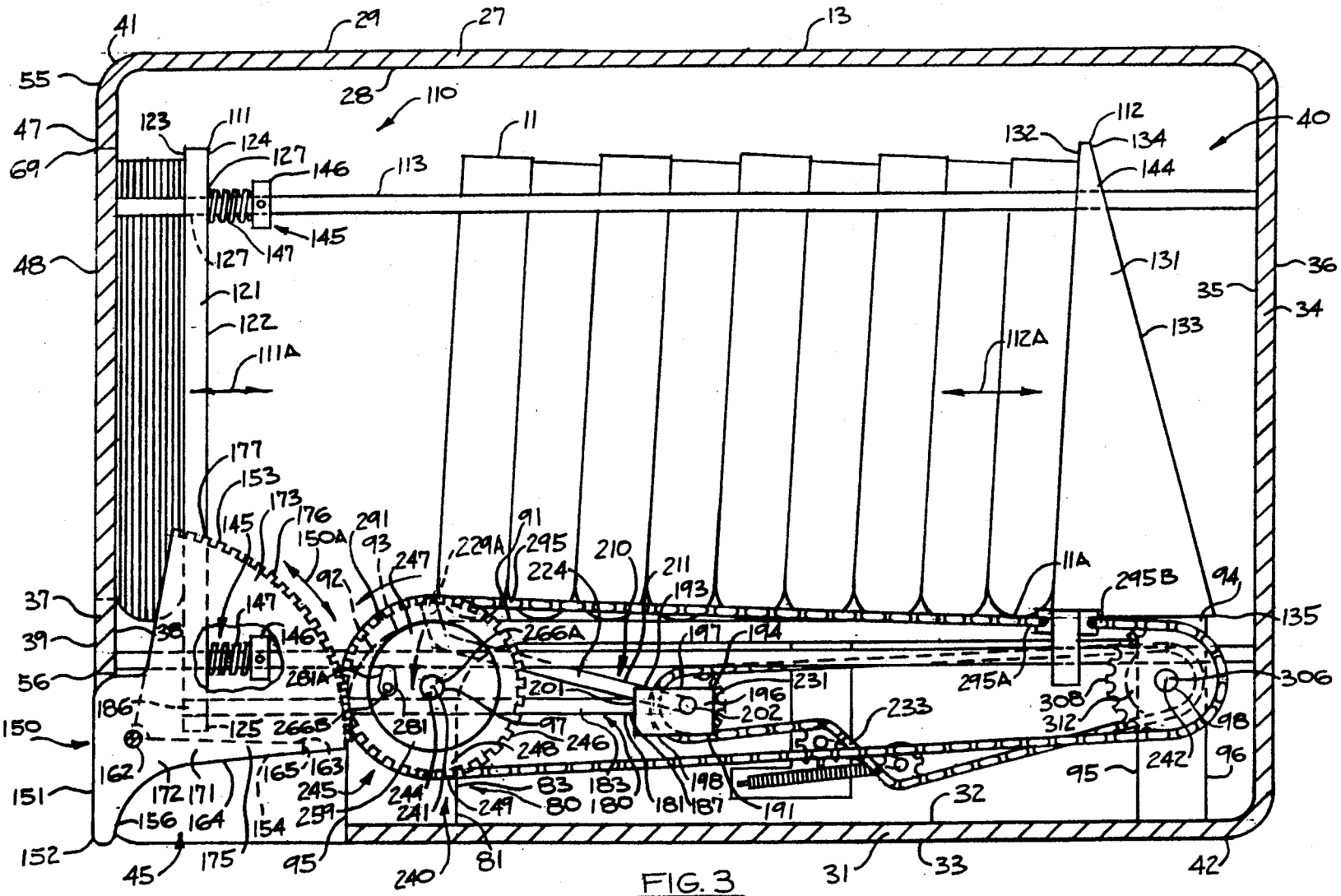
FIG. 3 is a right, partial, vertical, sectional view of the apparatus of the subject invention taken from a position along line 3—3 of FIG. 1.
Figure 4:
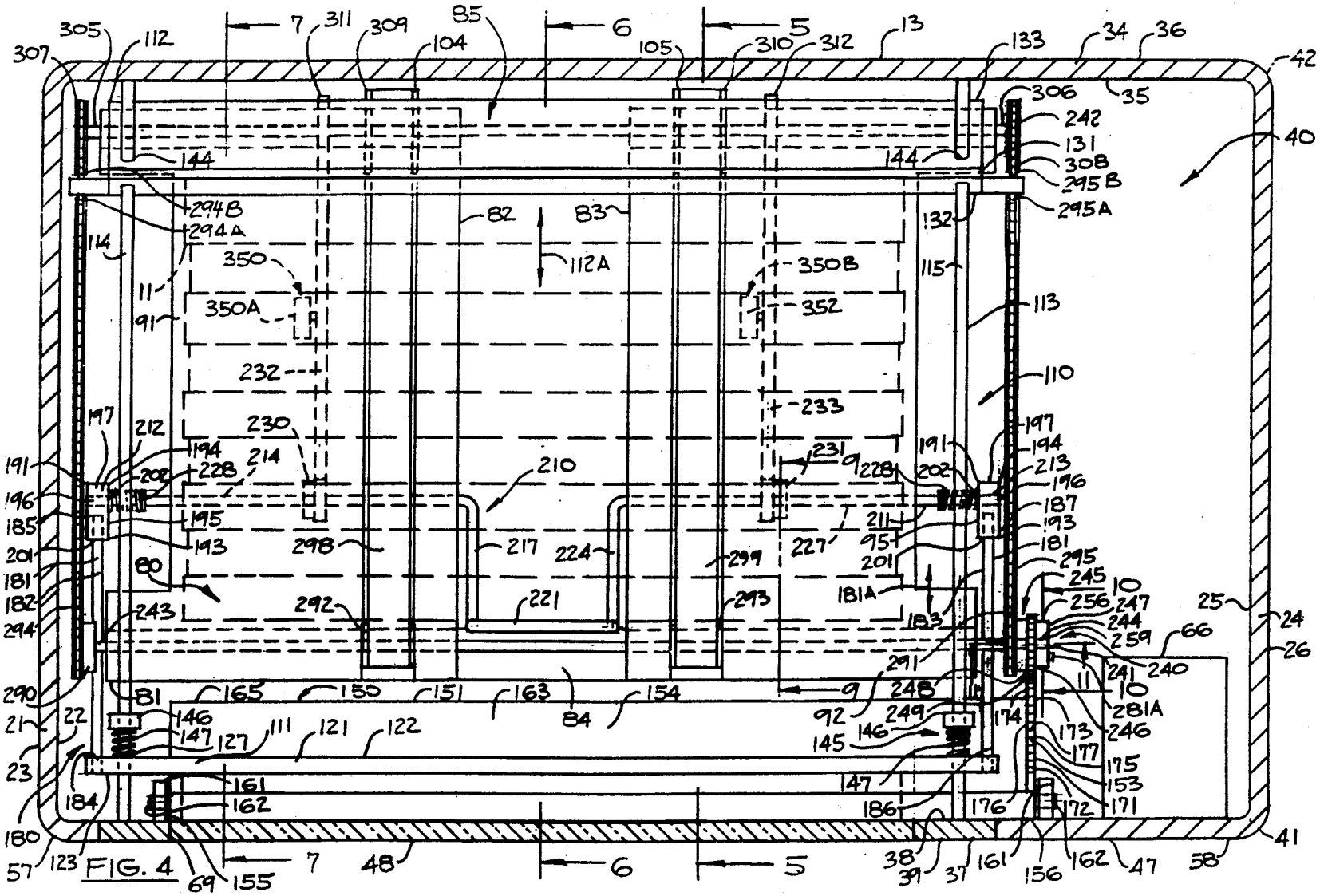
FIG. 4 is a plan view of the apparatus of subject invention which is taken from a position along line 4—4 of FIG. 2 and which has some supporting structures removed to show the detail thereunder.

As best illustrated by FIGS. 1, 3 and 4, the door or display assembly 37 includes a panel member or support frame 47; and a transparent panel, or viewing means 48 which may be manufactured from tempered glass, synthetic polymeric materials or other similarly suitable, rigid, yet transparent materials. The panel member or support frame is substantially rectangularly shaped and is defined by a top portion 55, an opposite bottom portion 56, and left and right sides, 57 and 58, respectively. Formed in predetermined positions in the panel member 47 are a plurality of apertures, namely a first aperture 65 which permits access to a coin deposit assembly, or holder 66; a second aperture 67, which permits access to a coin return box 68; and a third aperture 69 which is operable to receive the transparent panel or viewing means 48. As should be understood, the transparent panel or viewing means 48 is secured on the panel member 47, and within the aperture 69, by methods which are common knowledge in the industry, such as, for example, by employing suitable adhesives or caulking materials or by employing any number of fastening devices. In addition to the foregoing, the display assembly 37 is releasably engageable with the housing in such a fashion so as to permit access to the interior housing cavity 40, such as to service the apparatus 10, and to resupply or replenish the apparatus with additional newspapers 11. This operational characteristic of the display assembly will be explained in further detail in the paragraphs to follow. It is additionally anticipated that the interior housing cavity of the apparatus may be accessed by way of the roof panel 27. The display assembly would be secured to the housing by means of a lock, not shown.

As best seen by reference to FIGS. 1 and 2, the housing 13 is mounted in an angled or non-perpendicular relationship relative to the support assembly 12. More particularly, the exterior surface 33 of the floor panel 31 is made integral with, or fastened on the first end 15 of the post member 14 in such a fashion that the display assembly 37 and more particularly, the forward portion 41 of the housing are each oriented upwardly and in angled relationship relative to the surface of the earth 20. As should be readily apparent, this angled orientation between the housing and the post member permits a consumer or passerby to easily read a displayed newspaper 11 without changing their body position as compared with the relative difficulty associated with reading a display newspaper in a typical newspaper vending device which is located low to the ground, and which includes a substantially vertical display assembly.

As most clearly illustrated by reference to FIG. 8, the apparatus 10 includes a platform assembly which is generally indicated by the numeral 80, and which includes a main body 81 having a predetermined shape which is defined by a left platform portion 82 and a right platform portion 83. The platform further includes a major axis, 81A; and a minor axis, 81B, which is oriented perpendicular to the major axis 81A. Further, each platform portion includes a generally vertically oriented wall 84 which defines a generally U-shaped slot or aperture which is generally indicated by the numeral 85, and which is oriented in substantially coaxial alignment relative to the major axis 81A. In addition to the foregoing, the main body has a plurality of substantially coaxially aligned apertures 86 formed therein. The apertures accommodate individual support beams, or members which will be discussed in greater detail hereinafter. The platform is further defined by a top surface 91; a bottom surface 91B; a forward portion 92, which includes a forwardly disposed and arcuately shaped surface 93; an upper portion 94; a lower portion 95; and a rear portion 96. The lower portion 95 has formed therein opposite, first and second axle mounting apertures 97 and 98, respectively. More particularly, the first axle mounting aperture 97 is disposed in the lower, forward portion of the main body 81, and is oriented substantially parallel to the minor axis 81B, and the second axle mounting aperture 98 is disposed in the lower, rear portion of the main body and is also oriented substantially parallel to the minor axis 81B.

As best illustrated by reference to FIGS. 2, 3, 5, and 7 the folded edge portion 11A of the individual newspapers 11 are supported on the top surface 91. As should be understood, the forward curved surface 93 is disposed in registry, or discharge relation with the passageway 45 and is therefore operable to permit a newspaper 11 to easily exit the internal housing cavity 40 through the passageway 45. The lower portion 95 of the main body 81 of the platform 88 is moveably mounted on the interior surface 32 of the floor panel 31 and disposed in reciprocal, sliding relation thereto to permit servicing or resupply of the apparatus 10. Additionally, and in the instance where the housing 13 is resupplied through the roof panel 27, it should be understood that the platform 80 would not be reciprocally moveable.

The lower portion 95 is operable to locate the upper portion 94 of the platform a predetermined distance above the interior surface 32. The predetermined spaced relationship between the interior surface 32, of the floor panel 31 and the bottom surface of the upper portion 94 of the platform main body forms an operating cavity which is generally indicated by the numeral 101, and which will be described in further detail in the paragraphs which follow. In addition to the foregoing, and as best illustrated by reference to FIGS. 4, 5, 8, and 9, the left and right platform portions, 82 and 83, respectively, each have formed in their respective upper portions 94 individual belt channels 104 and 105, respectively. The left and right belt channels 104 and 105, respectively, are each defined by an interior facing channel surface 104A and 105A, respectively. The respective belt channels are oriented in substantially parallel relation relative to the major axis, 81A. The belt channels are individually operable to house or enclose respective belt drive assemblies which will be described in further detail hereinafter. As noted, above, the platform assembly is reciprocally and slidably mounted in the interior housing cavity in such a fashion that the platform moves from a first, operating position, to a second, extended, or servicing position. Any number of known sliding support assemblies (not shown) would accommodate such movement by the platform. Accordingly, and in a situation where the apparatus 10 requires servicing or resupply of newspapers, the display assembly 37 is pulled from the first operational position away from the housing 13, to the second position. Upon completion of servicing and/or resupplying activities, the platform is urged back into the first, operating position.

Figure 8:
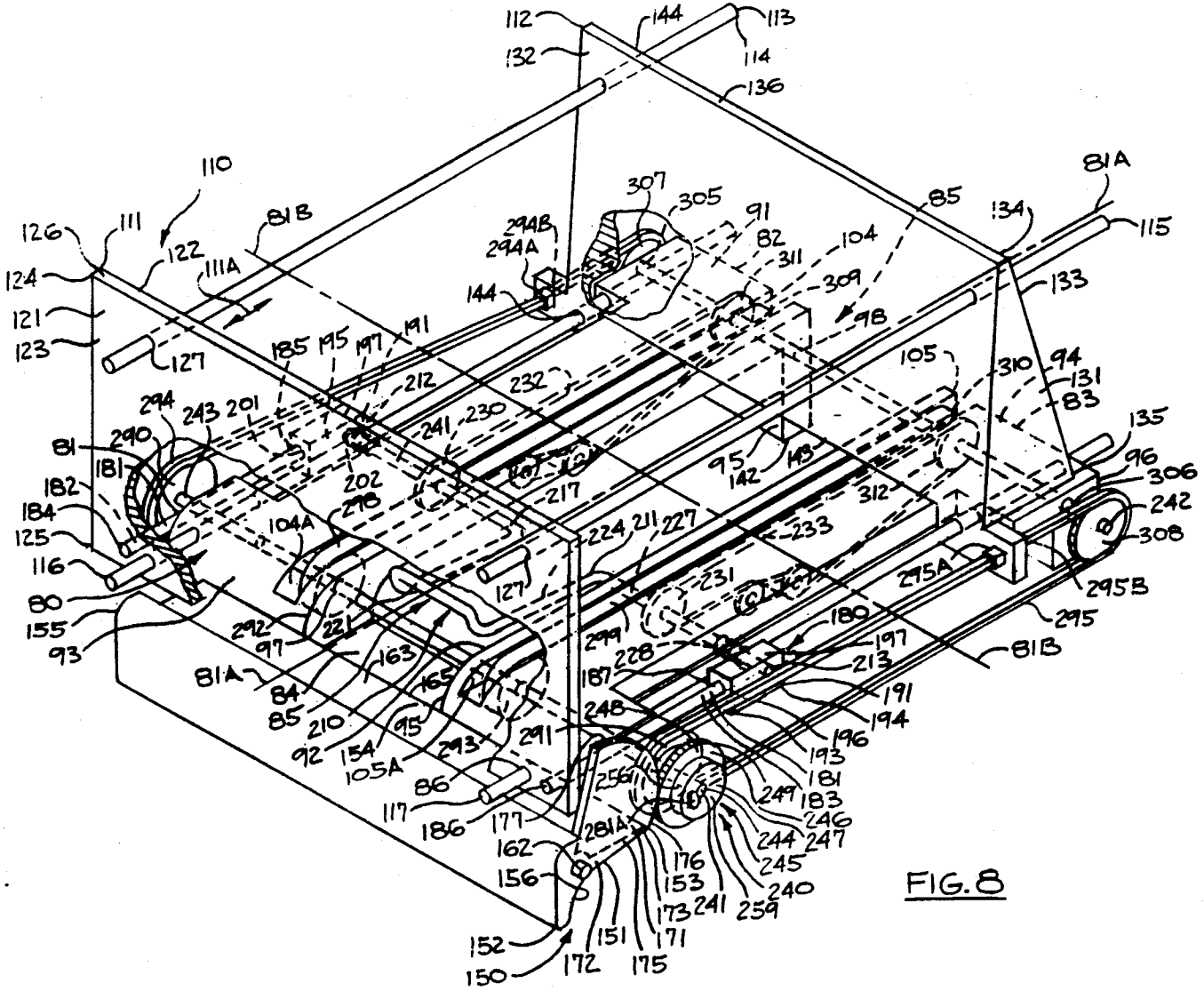
FIG. 8 is a perspective view of the apparatus of the subject invention with many supporting surfaces removed to illustrate the structure thereunder.

As best illustrated in FIG. 8, the apparatus 10 employs a support frame 110 which includes a forward support assembly 111, and a rearward support assembly 112. The support frame 111 further includes a plurality of elongated support beams, shafts, or members 113, which have substantially circular cross-sectional shapes. The individual support beams are designated as first, second, third, and fourth support beams 114, 115, 116 and 117, respectively, hereinafter. As best seen by reference to FIG. 4, the individual support beams are made integral with, or are fastened on the display assembly 37, and extend generally normally, rearwardly thereof.

Figure 7:
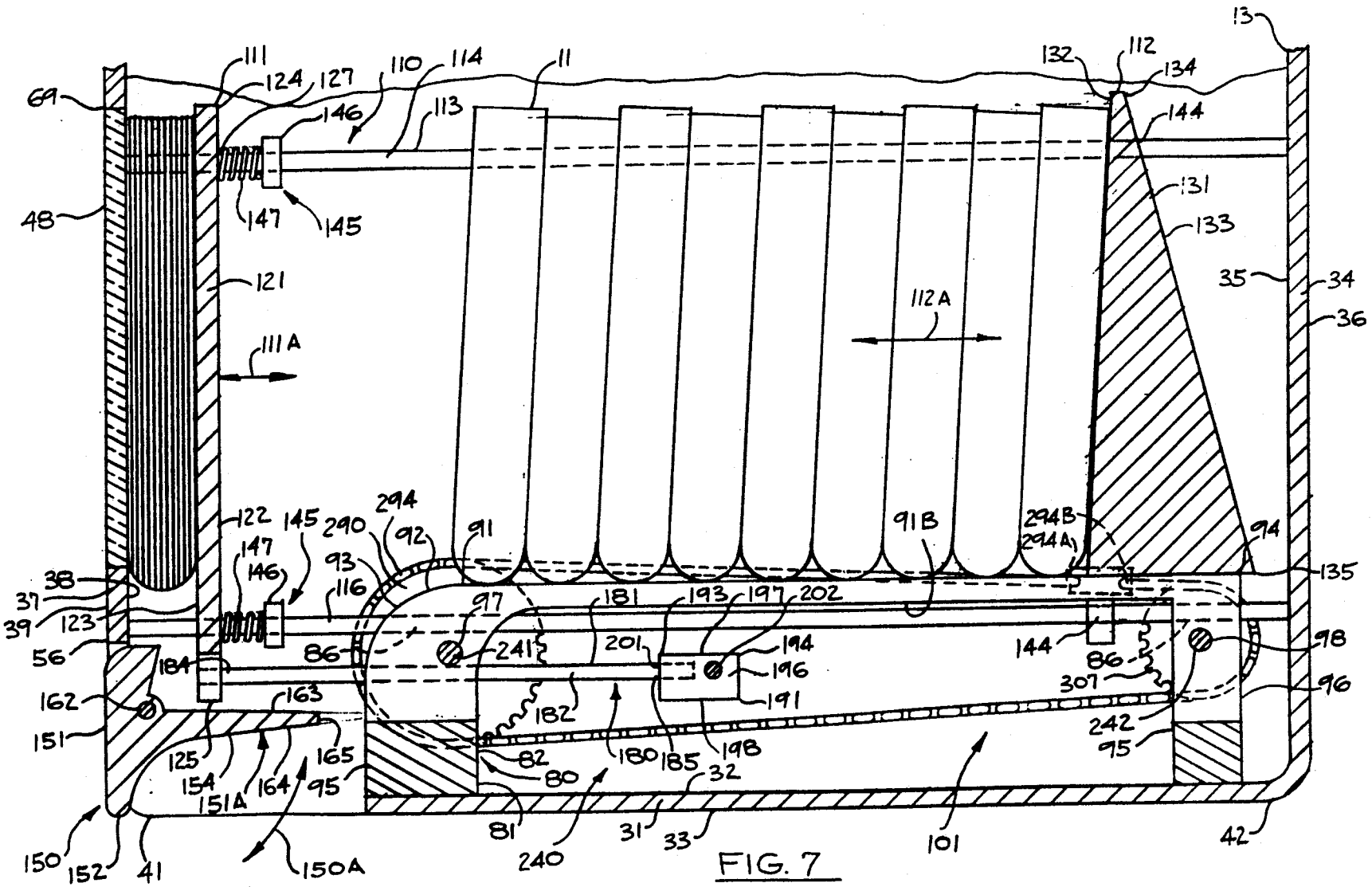
FIG. 7 is a fragmentary, vertical, sectional view of the apparatus of the subject invention taken from a position along line 7—7 of FIG. 4.

As best seen by reference to FIG. 7, the forward support assembly 111 includes a substantially rectangular shaped main body 121 which includes interior and exterior facing surfaces 122 and 123, respectively. Further, the main body 121 includes a top portion 124, a bottom portion 125, and is further defined by a peripheral edge 126. Additionally, a plurality of apertures 127 are formed in the main body 121, and are disposed in a predetermined pattern. The apertures are oriented in a normal relationship relative to the interior facing surface 122. The individual apertures are operable to slidably receive the support beams 113.

The rearward support assembly 112 includes a main body 131 having a diminishing thickness dimension, and which further includes interior and exterior facing surfaces, 132 and 133, respectively. Further, the main body 131 includes a top portion 134, a bottom portion 135, and a peripheral edge 136. Additionally, the bottom portion of the rear support assembly 131 has formed therein a slot 142 which is defined by a peripheral edge 143, and which is operable to slidably engage the main body 81 of the platform 80. A plurality of apertures 144 are formed in the main body 131 and are disposed in a predetermined pattern. The apertures are disposed in a normal relationship relative to the interior facing surface 132 and are operable to receive the individual support beams 113.

As should be understood by reference to FIG. 8, the individual support beams 113 provide a framework upon which the forward and rearward support assemblies, 111 and 112, respectively, may be slideably mounted for operation. The individual support beams are spaced or otherwise positioned approximately equal distances one from the other. Further, the individual beams are positioned in substantially parallel, spaced relation one to the other and ar otherwise positioned in substantially normal relation relative to the forward and rearward support assemblies. As best seen by reference to FIGS. 7 and 8, the third and fourth support beams are received through the apertures 86 which are formed in the platform. Further, these same support beams are releasably fastened on the platform at their rearmost ends making the display assembly 37 integral with the platform 80 such that the display assembly and platform may move as a single unit out of the housing 13 for servicing, or the like.

As best illustrated by reference to FIGS. 3, 4, 6, and 7, the forward support assembly 111 is biasedly mounted for limited rearward travel on the respective support beams 113. More particularly, the forward support assembly is operable for limited, biased travel along a path of travel 111A which is substantially coaxially aligned with the major axis 81A. As should be understood, each of the support beams has mounted thereon a biasing assembly 145, which includes a washer 146, and a biasing means 147 which is illustrated herein as a coil spring. Each washer 146 is fastened on, or otherwise made integral with the respective support beams 113. The biasing assemblies 145 are each operable to urge the forward support assembly in the direction of the display assembly 37. During operation, the forward support assembly is operable to position or orient a single newspaper 11 against the interior portion 38 of the display assembly 37 for viewing from a position outside the housing 13. More particularly, the forward support assembly is manually moved, rearwardly, along the support frame 110 thereby compressing the individual biasing assemblies 145. When this is achieved, a single newspaper is placed between the interior portion 38 of the display assembly 37, and the exterior facing surface 123 of the forward support assembly 111. Upon placing the newspaper in this position, the forward support assembly is released thereby permitting the individual biasing assemblies 145 to urge the forward support assembly toward the display assembly 37 thus positioning or sandwiching the newspaper therebetween. Of course, the transparent panel 48 permits the newspaper to be read or viewed from a position outside or exterior to the housing 13.

As best illustrated by reference to FIGS. 3, 4, 6, 7 and 8 the rearward support assembly 112 is slidably mounted on the support frame 110. More particularly, the apertures 144 are each individually operable to receive the respective first, second, third and fourth support beams 114, 115, 116 and 117, respectively, as earlier discussed. Further, and as noted above, the slot 142 which is formed in the bottom portion 135, is operable to slidably receive the upper portion 94 of the main body 81. As should be understood, the rearward support assembly reciprocally moves within the interior housing cavity 40 and in mating engagement on or with the platform surface 91. Further, the rearward support assembly moves along a path of travel 112A which is substantially coaxially oriented relative to the major axis 81A.

FIGS. 3 through 8, respectively, illustrate an actuator which is generally indicated by the numeral 150. The actuator is defined by a substantially elongated and rotatable main body 151. The actuator further includes a handle portion 152; a drive portion 153; and an occluding portion 154. The main body includes a first end 155; and an opposite second end 156. The main body 151 is rotatably mounted on the bottom portion 56 of the display panel 47 by conventional mounting methods which are well understood in the industry. For example, and as best illustrated by reference to FIG. 4, a pair of opposite, first and second mounting brackets 161 are fastened on, or otherwise made integral with, the interior facing surface 38 of the display assembly 37. The first and second ends of the main body 151 are respectively rotatably mounted on the first and second mounting brackets, such as, for example by utilizing individual axle members 162 or other similar assemblies. The axle members define the axis of rotation for the actuator. A suitable biasing means (not shown) such as a pair of springs are operable to bias or urge the main body about the axis of rotation in a predetermined counter-clockwise direction as that is viewed from FIG. 3. When the actuator is properly mounted on the display assembly 37, the axis of rotation is oriented substantially parallel to the minor axis 81B of the platform 80.

As should be understood, the main body 151 is operable for movement about the axis of rotation and along a rotational path of travel 150A from a first, substantially occluding, non-vend position 151A, to a second, substantially non-occluding, vend position 151B. Upon release of the actuator 150, the biasing means which, will normally include a pair of springs, urges the actuator into the first, non-vend position. The occluding portion 154 is generally elongated and substantially rectangularly shaped. Further, the occluding portion includes a top surface 163, and an opposite bottom surface 164. The occluding portion extends from the first end 155 to the second end 156, and is further defined by a peripheral edge 165. As should be understood, the occluding portion 154 is operable to selectively occlude the passageway 45. More particularly, and when the actuator is disposed in the first, non-vend position, the occluding portion 154 substantially occludes the passageway 45 thereby restricting or inhibiting access to the housing cavity 40 from a location outside the housing. This, of course, substantially impedes theft of the newspapers. Additionally, and when the actuator is moved to the second, vend position, the occluding portion 154 is driven to a substantially non-occluding position relative to the passageway 45 thereby permitting a newspaper 11 to be dispensed from the housing cavity 40.

The drive portion 153 of the actuator 150 includes a main body 171, having a first end 172; a second, substantially arcuately shaped end or portion 173; an interior facing surface 174; and an exterior facing surface 175. Further, the main body 171 is defined by a peripheral edge 176. As best illustrated by reference to FIGS. 3, 4, and 8, the first end 172 is fastened on, or otherwise made integral with the second end 156 of the actuator 150. Formed along the peripheral edge 176 of the arcuately shaped second end, or portion 173, are a plurality of substantial equally spaced teeth 177. As should be understood, the teeth 177 are disposed in force transmitting relation relative to a drive assembly which will be explained and described in further detail in the paragraphs which follow.

As best seen by reference to FIGS. 3 through 8, the apparatus 10 includes a carriage assembly which is generally indicated by the numeral 180, and which is further moveable along a path of travel labeled 181A. The carriage assembly includes a pair of elongated support beams or shafts 181, which have substantially circular cross-sectional shapes. The individual support beams are designated as first and second support beams, 182 and 183, respectively, hereinafter. The first support beam 182 includes opposite first and second ends, 184 and 185, respectively. Likewise, the second support beam 183 includes opposite first and second ends, 186 and 187, respectively. The first end, 184 and 186, respectively of the individual support beams, are fastened on, or made integral with, the forward support assembly 111. More particularly, the first and second support beams are positioned in a predetermined pattern, and are oriented in substantially parallel, spaced relation, one to the other. The first end 184, and 186, of each of the support beams are made integral with or fastened on the bottom portion 125 of the forward support assembly 111 by methods with are commonly understood in the art, such as, for example, by utilizing welding, adhesives, or other screw-type fasteners. When properly mounted on the forward support assembly, the first and second support beams extend substantially normally, rearwardly, relative to the interior facing surface 122, and are otherwise disposed in a predetermined location within the operating cavity 101 between the bottom surface 91B of th : upper portion 94 of the platform 80; and the interior surface 32 of the floor panel 31.

In addition to the foregoing, the carriage assembly 180 includes a pair of mounting blocks 191. Each mounting block has a substantially rectangular shaped main body 192 which is defined by opposite first and second ends 193 and 194, respectively; opposite interior and exterior facing surfaces 195 and 196, respectively; and opposite top and bottom surfaces 197 and 198, respectively. Formed in the first end 193 and the interior facing surfaces 195, of each of the mounting blocks are individual apertures 201 and 202, respectively. The apertures 201 are each operable to receive the second end 185 and 187, respectively, of the first and second support beams 182 and 183. When properly mounted or fastened on the support beams, the first and second ends 193 and 194 of the respective mounting blocks 191 are oriented substantially parallel to the major axis 81A, and the pair of apertures 202 are disposed in substantially coaxial alignment, one to the other. As should be understood, the pair of apertures 202 are operable to rotatably receive a metering assembly which will be described in further detail in the paragraphs which follow.

As best illustrated by reference to FIGS. 4 and 8, the apparatus 1? includes a metering assembly 210. The metering assembly includes an elongated, generally exaggerated parabolic or u-shaped main body 211 when the object is viewed from FIG. 14. The metering assembly has a first end 212, and a second end 213. The main body 211 is defined by plurality of body sections, namely, a first section 214; a second section 217; a third section 221; a fourth section 224; and a fifth section 227.

As should be understood, the first section is located at the first end 212 of the main body 211. Made integral with the first section, and disposed in substantially perpendicular relation thereto, is the second section. The third section 221 is made integral with the second section, and is generally oriented in perpendicular relation thereto when viewed from FIG. 4. Additionally, the fourth section is made integral with the third section and is disposed in substantially perpendicular relation thereto when viewed from FIG. 4. Finally, the fifth section is made integral with the fourth section. Moreover, the fifth section is located at the second end 213 of the main body 211. As best illustrated by a Comparative study of FIGS. 4 and 8, the first section 214 of the metering assembly 210 is oriented in substantial coaxial alignment relative to the fifth section 227, and is further disposed in predetermined space relation relative thereto. The first and fifth sections, respectively, define an axis of rotation for the metering assembly. Further, the second and fourth sections of the metering assembly are disposed in substantially parallel spaced relation, one to the other. Finally, the third section 221 is oriented in substantially parallel spaced relation relative to the first and fifth sections when this is viewed from FIG. 4.

The metering assembly 210 is mounted for biased, pivotal movement on the carriage assembly 180. More particularly, the individual apertures 202 of the mounting blocks 191 are operable to rotatably receive the respective first and second ends 212, and 213 of the metering assembly 210. Further, a biasing means such as a pair of torsion springs 228 are individually operable to bias or otherwise move or urge the metering assembly about its axis of rotation in a predetermined clockwise direction, and along the path of travel 210A, as that is viewed from FIGS. 5 and 9. As best seen by reference to FIGS. 3 and 9, the third section of the metering assembly is disposed in, or towards, the forward portion 41 of the housing 13. As should be understood, and during operation, the metering assembly is operable to reciprocally move along the path of travel 210A from a first position 229A wherein the metering assembly partially occludes the platform slot 85 thereby inhibiting forward movement of the newspapers within the housing 13; to a second position 229B, wherein the metering assembly is disposed in substantially non-occluding relation relative to the platform slot thereby permitting an individual newspaper to exit from the interior housing cavity 40. As should be understood, each of the torsion springs are individually operable to bias the metering assembly into, or towards, the first position 229A.

First and second drive clutches, 230 and 231, respectively, are individually mounted on the metering assembly 210 in predetermined locations. The individual drive clutches, 230 and 231 are each operable to matingly engage, in force receiving relation, a pair of drive chains 232 and 233, respectively. Operation of the first and second drive clutches, in combination with the drive chains and metering assembly, will be described in further detail hereinafter.

As best illustrated by reference to FIGS. 4 and 8, the apparatus 10 of the subject invention includes a drive assembly which is generally indicated by the numeral 240, and which includes first and second drive axles, 241 and 242, respectively. The first drive axle 241 includes opposite first and second ends 243 and 244, and is rotatably mounted in the forward portion 92 of the main body 80. More particularly, the first axle mounting apertures 97 rotatably receive and position the first drive axle for operation in such a fashion that the first end 243 extends substantially normally outwardly relative to the left platform portion 82, and the second end 244 extends substantially normally outwardly relative to the right platform portion 83. Once properly mounted, the first drive axle is oriented substantially parallel to the minor axis 81B.

Figure 10:
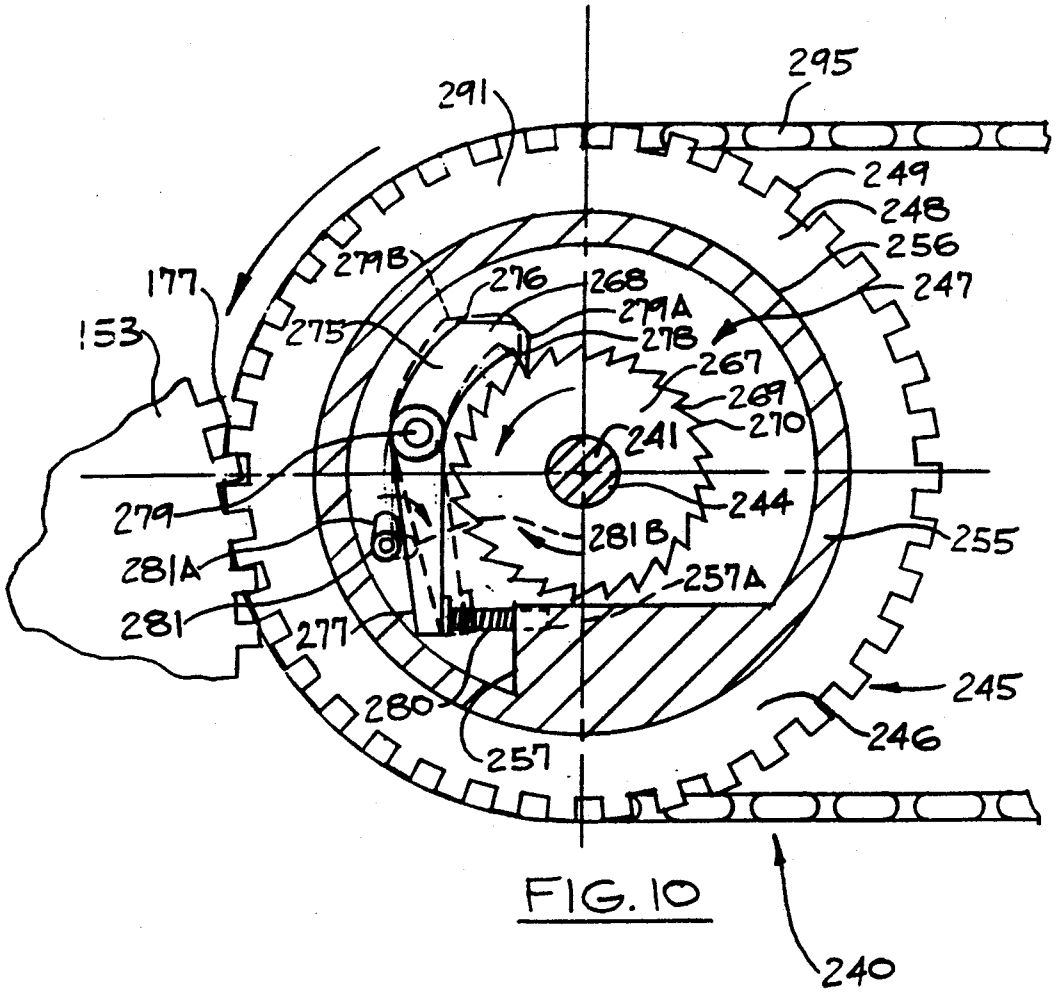
FIG. 10 is a fragmentary, vertical, sectional view of the apparatus of the subject invention taken from a position along like 10—10 of FIG. 4.
Figure 11:
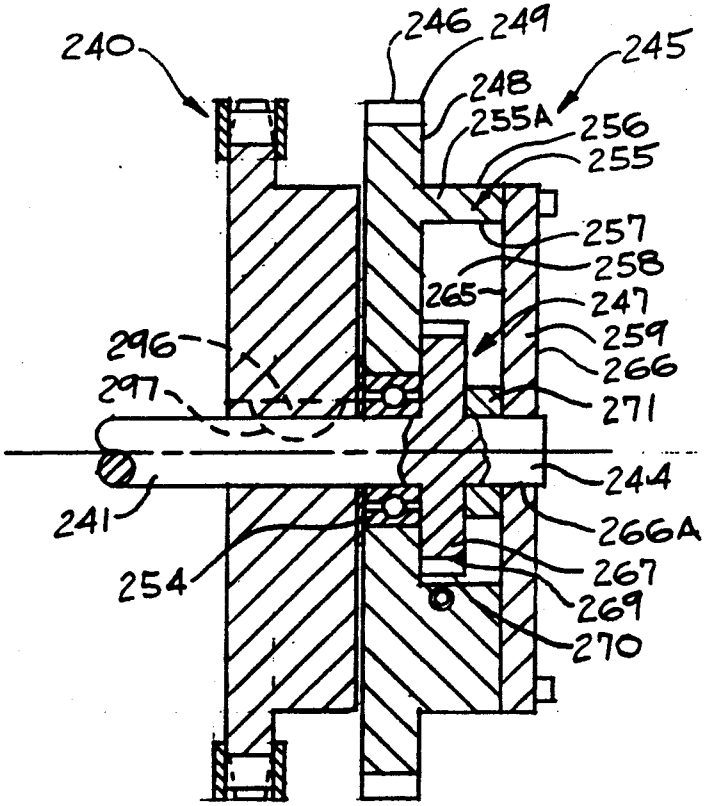
FIG. 11 is a fragmentary, vertical, sectional view of the apparatus of the subject invention taken from a position along line 11—11 of FIG. 4.

A drive gear including a pawl and ratchet assembly, and which is generally indicated by the numeral 245, is mounted on the second end 244 of the first drive axle 241. More particularly, the assembly 245 includes a drive gear 246 and a pawl and ratchet assembly which is generally indicated by the numeral 247. The drive gear 246 is of conventional design having a generally circular main body 248 which is defined by a toothed peripheral edge 249. Turning now to FIGS. 10 and 11, the circular main body 248 is rotatably mounted on the first drive axle 241 by means of a bearing 254. The bearing 254 is of conventional design and is operable to be received, as by a friction fit, on the first drive axle 241, and is further received in an aperture formed in the circular main body 248. Therefore, and during operation, the bearing 254 permits the drive gear 246 to freely rotate about the first drive axle 241. A housing 255 is lade integral with the circular main body 248. The housing includes a wall 255A which has an exterior facing surface 256, and an interior facing surface 257. The interior facing surface 257 defines an operating cavity 258 within which the pawl and ratchet assembly 247 is enclosed. A cover plate 259 which has an interior facing surface 265 and an exterior facing surface 266 substantially occludes the operating cavity 258. An aperture 266A is formed in the cover plate and is operable to accommodate the second end 242 of the axle 24. Further, an aperture 266B is formed in the cover plate and is adapted to accommodate a pawl disengagement member which will be discussed in greater detail hereinafter.

The pawl and ratchet assembly 247 includes a ratchet wheel 267 and a pawl 268. The ratchet wheel 267 has a predetermined shape which is defined by a peripheral edge 269 which has a plurality of teeth 270 formed therein. The ratchet wheel 267 is fixed on, or otherwise made integral with, the first drive axle 241 and is disposed for rotatable motion in the operating cavity 258 a predetermined distance from the interior cover plate surface 265, and separated by a washer 271 therefrom. The washer acts as a spacer. The pawl 268 includes a main body 275 having a first end 276, and a second end 277. Formed on the first end 276 is a drive tooth 278 which is operable to engage the individual teeth 270 of the ratchet wheel 267. As should be understood, the main body of the pawl is pivotally mounted on the interior facing surface 257 and within the operating cavity 258 by a means of a pin 279. The pin 279 defines an axis of rotation about which the pawl reciprocally pivots during operation from a first, ratchet wheel engaged position 279A, to a second, ratchet wheel disengaged position 279B. A biasing means, herein illustrated as a compression spring 280, is fixed or positioned on the interior facing surface 257 and biasedly engages or otherwise imparts force to the second end 277 of the pawl thereby urging the drive tooth into the first ratchet wheel engaged position 279A. In addition to the foregoing, the main body 248 supports a pawl disengagement member 281 which is operable to selectively position the first end of the pawl in the second, ratchet wheel disengaged position. More particularly, the pawl disengagement member is operable to travel from a first position 281A wherein the pawl disengagement permits the first end of the pawl to remain in the first ratchet wheel engaged position 279A, to a second position 281B, wherein the pawl disengagement member drives the first end of the pawl into the second, ratchet wheel disengaged position 279B. The pawl disengagement member has a hand manipulatable member 281A which extends through the aperture 266B which is formed in the cover plate 259.

As should be understood by a comparative study of FIGS. 3, 4, 8, 10, and 11 the pawl and ratchet assembly 247 are operable, in combination, to transmit force to the first drive axle 241, and are also operable to permit the actuator 150 to return from the second, vend position 151B, to the first, non-vend position 151A during operation. More particularly, the toothed surface 249 of the drive gear 246 is disposed in force receiving relation relative to the teeth 177 of the actuator drive portion 153. Therefore, rotational movement of the actuator 150 from the first, non-vend position 151A, to the second, vend position 151B imparts a corresponding counterclockwise rotational movement to the drive gear 246. Rotation of the drive gear in the counter-clockwise direction causes the pawl 268 to engage the ratchet wheel thereby urging it in the counterclockwise direction. Further, rotation of the ratchet wheel imparts a similar rotational movement to the first drive axle. Conversely, and when the actuator 150 is caused to return to the first, non-vend position 151A from the second vend position 151B, the drive gear is rotated in the opposite clockwise direction by the actuator thereby causing the pawl to rotate, or otherwise slip over the peripheral edge 269 of the ratchet wheel in the ratchet wheel disengaged position, whereby the actuator returns to the first non-vend position 151A.

As best depicted in FIGS. 4 and 8, a plurality of sprockets and pulleys are mounted or fixed on the first drive axle 241 and are operable for rotational movement with the first drive axle. The plurality of sprockets and pulleys include first and second forwardly disposed chain sprockets 290 and 291, respectively, and first and second forwardly disposed belt drive pulleys 292 and 293, respectively. The forwardly disposed chain sprockets are operable to engage first and second drive chains, 294 and 295, respectively, which will be described in further detail in the paragraphs which follow. The first, forwardly disposed chain sprocket 290 is mounted for operation on the first end 243 of the drive axle 241, and the second forwardly disposed chain sprocket 291 is rotatably mounted on the second end, 244, of the first drive axle. The first and second forwardly disposed chain sprockets are fastened on or are otherwise made integral with the first drive axle 241 by conventional methods which are commonly known in the art, such as, for example, by a key 296 and a keyway 297 which are best illustrated in FIG. 11 The first and second forwardly disposed belt drive pulleys 292 and 293 are mounted or fixed on the first drive axle in predetermined positions within the first and second drive belt channels, 104 and 105, respectively. The respective drive pulleys are each operable to drive the first and second belts 298 and 299, respectively.

The second drive axle 242 includes opposite first and second ends 305 and 306, respectively. The second drive axle as best seen in FIG. 4 and 7 is rotatably mounted on the rear portion 96 of the platform 80. More particularly, the second axle mounting apertures 98 rotatably receive and position the second drive axle for operation in such a fashion that the first and second ends 305 and 306 extend substantially normally outwardly relative to the rear portion. Once appropriately mounted, the second drive axle is oriented substantially parallel to the minor axis 81B. A plurality of sprockets and pulleys are mounted or fixed on the second drive axle and are operable for rotational movement therewith. The plurality of sprockets and pulleys include first and second rearwardly disposed chain sprockets 307 and 308, respectively; first and second rearwardly disposed belt drive pulleys 309 and 310, respectively; and first and second rearwardly disposed metering drive sprockets 311 and 312 respectively. The rearwardly disposed chain sprockets 307 and 308 are substantially similar to the first and second forwardly disposed chain sprockets of the first drive axle, that is, the first and second rearwardly disposed chain sprockets are operable to engage the first and second drive chains, 294 and 295, respectively and are thus disposed in force receiving relation relative to the first and second forwardly disposed chain sprockets. Further, the first rearwardly disposed chain sprocket 307 is mounted or fixed on the first end 305 of the second drive axle and is oriented in substantial alignment with the first forwardly disposed chain sprocket 290; and the second rearwardly disposed chain sprocket 308 is fixed on the second end 306 of the second drive axle and disposed in substantial alignment relative to the second forwardly disposed chain sprocket 291. This relationship is best seen in FIG. 4.

As best illustrated by reference to FIGS. 3, 4, 6, 7 and 8 the first drive chain 294 includes a first end 294A which is fixed on the bottom portion 135 of the rear support assembly 112, and a second end 294B, which is also attached on the bottom portion of the rear support assembly. Likewise, the second drive chain 295 includes first and second ends 295A and 295B which are individually mounted on the bottom portion of the rear support assembly. Accordingly, it should be understood that rotational movement imparted to the first and second forwardly disposed chain sprockets 290 and 291, respectively, by means of the first axle assembly 241, is operable to impart force by way of the drive chains 294 and 295 to urge the rear support assembly forwardly within the interior housing cavity and along the path of travel 112A. Additionally, and when the apparatus 10 is resupplied with newspapers 11, the pawl disengagement member 281 is positioned in the second, ratchet wheel disengaged position 281B thereby permitting the rearward support assembly 112 to be urged rearwardly of the housing 13. This is best imagined by a study of FIGS. 4 and 10, respectively.

The first and second rearwardly disposed belt drive pulleys, 309 and 310, are fastened or mounted on the second drive axle 242 in predetermined positions within the first and second drive belt channels, 104 and 105, respectively. The rearwardly disposed belt drive pulleys are substantially identical to the first and second forwardly disposed drive belt pulleys. The first and second rearwardly disposed belt drive pulleys are further operable to frictionally engage the first and second drive belts 298, and 299, respectively. As best seen by reference to FIG. 8, the first belt drive pulley 309 is disposed in substantial alignment with, and in belt driving relation relative to, the first forwardly disposed belt drive pulley 292; and the second rearwardly disposed belt drive pulley 310 is disposed in substantial alignment with, and belt driving relation relative to the second, forwardly dispose belt drive pulley 293.

The first and second metering drive sprockets 311 and 312 are mounted or otherwise fixed on the second drive axle 242 and are disposed in alignment with, and force transmitting relation relative to the first and second drive clutches 230 and 231, respectively, by way of the individual drive chains 232 and 233, respectively. As will be described in further detail hereinafter, the first and second metering drive sprockets 307 and 308, respectively, are operable to impart or transmit force to, or through, the first and second drive chains 232 and 233, respectively, thereby causing the first and second drive clutches to drivingly engage the metering assembly 210.

Figure 9:
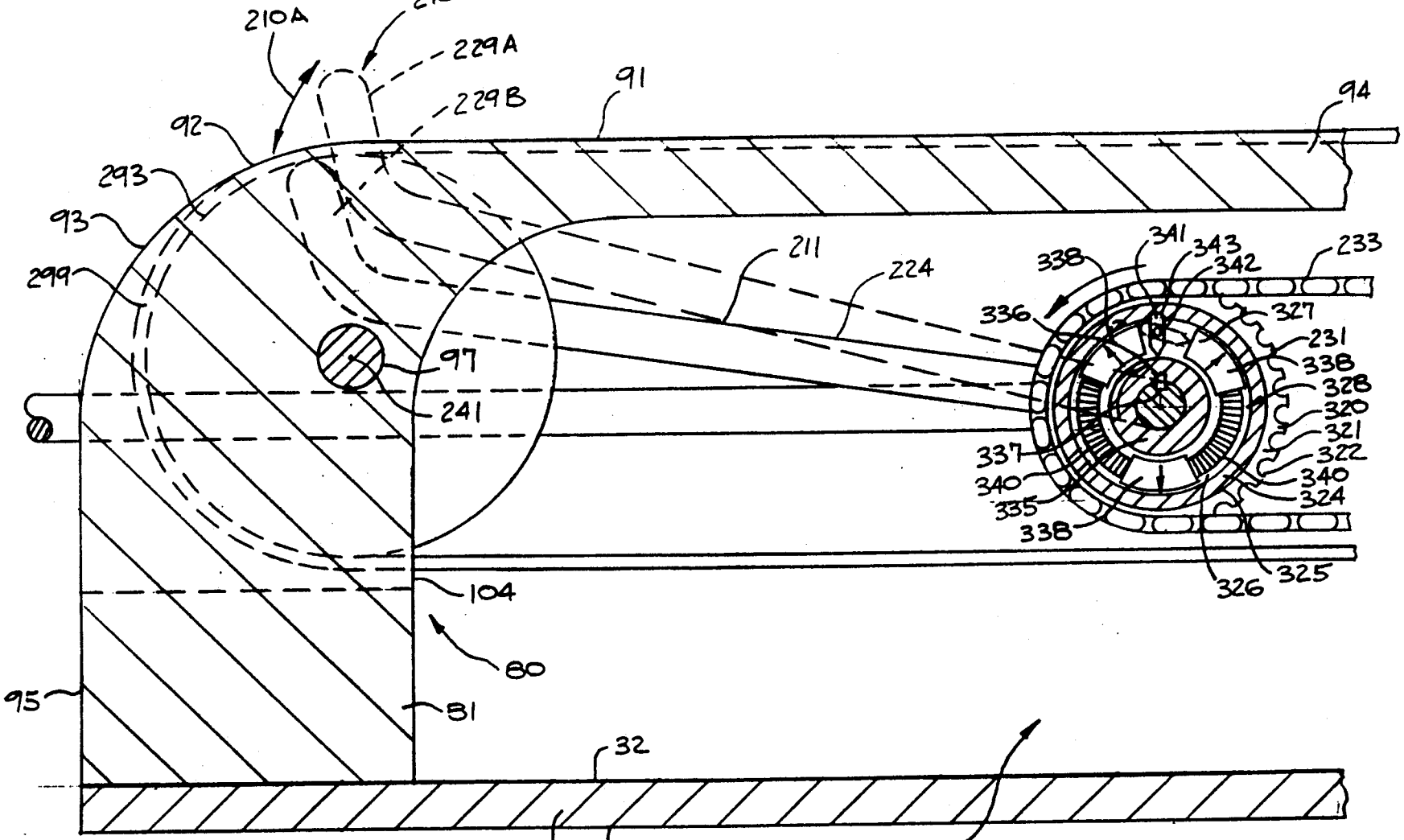
FIG. 9 is a fragmentary, vertical, sectional view of the apparatus of the subject invention taken from a position along line 9—9 of FIG. 4.
Figure 12:
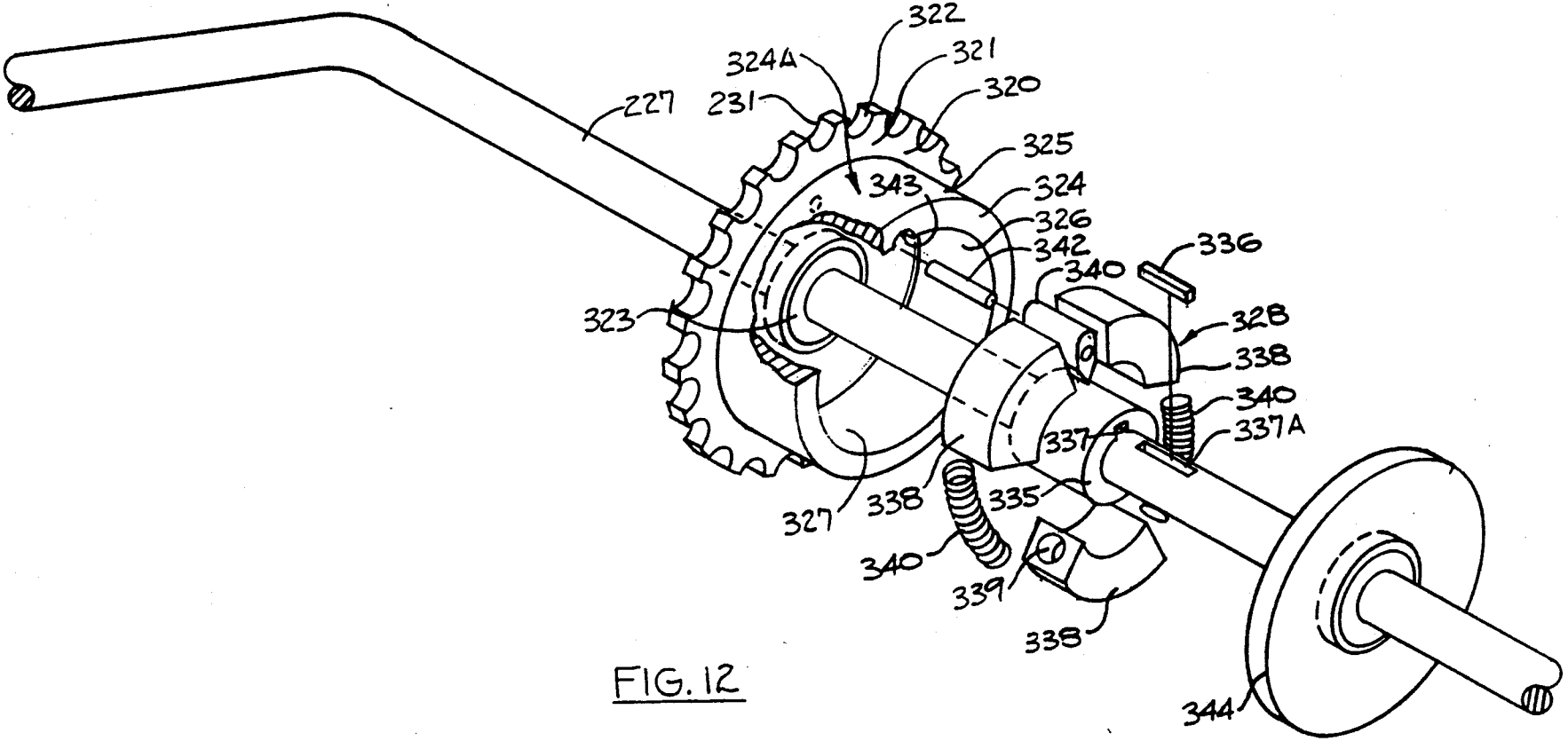
FIG. 12 is a fragmentary, exploded view of the subassembly illustrated in FIG. 9.

As best illustrated by a comparative study of FIGS. 9 and 12, and as discussed earlier, the individual drive clutches 230 and 231 are operable to reciprocally move the metering assembly 210 along the path of travel 210A from the first position 229A, wherein the metering assembly partially occludes the platform slot 85; to the second position 229B wherein the metering assembly is disposed in substantially non-occluding relation relative to the same platform slot. A drive clutch especially well suited for the purposes described herein is a commercially available automatic resetting torque clutch product which is marketed under the trademark TORQ-TENDER ®. TORQ-TENDER ® is the registered trademark of Helland Research & Engineering, Inc.

As best illustrated by reference to FIG. 9, each drive clutch includes a drive gear 320. The drive gear 320 has a generally circular main body 321 which is defined by a toothed, peripheral edge 322. The circular main body is freely, rotatably mounted on the metering assembly by means of a bearing 323. A housing 324 is made integral with the main body 321. The housing is defined by a circular wall 324 which has an exterior facing surface 325; and an opposite interior facing surface 326. The interior facing surface defines an operating cavity 327 within which a clutch assembly 328 is enclosed. The clutch assembly includes a bushing 335 which is attached, or fixed on, or made integral with, the metering assembly by means of a key 336 and a keyway 337. The keyway 337 is formed in the bushing, and the key is held in place by a channel 337A which is formed in the metering assembly. Located or disposed about the bushing and within the housing are three slides 338. Each slide has formed in one of its ends, a channel 339, which is operable to receive one end of a spring 340. The individual springs 340 are received in each of the channels and are operable to compress or urge two of the slides against a pawl 341. The pawl 341 is pivotally mounted on a pin 342 and is reciprocally moveable, into and out of mating relation relative to a detent 343 which is formed in the interior facing surface 326 of the wall 324. A cover plate 344 encloses the clutch assembly within the housing.

As should be understood, and during operation, rotation of the second drive axle 242 causes the first and second metering drive sprockets, 311 and 312, respectively, to rotate the first and second drive clutches, 230 and 231, by way of the drive chains 232 and 233. Power is transferred into the respective drive clutches by way of the pawl 341 which is held, by the effect of friction, and by means of the individual springs 340 in the detent 343. As earlier discussed, rotation of the drive gear 320 rotates the metering assembly, by way of the pawl 341, from the first position 229A into the second position 229B. Continued rotation of the second drive axle beyond the second position 229B causes the individual torsion springs 228 to impart excessive torque upon the pawl 341. When the torque reaches a predetermined level, the force on the pawl overpowers the force of the springs 340 thereby causing the pawl to rotate out of the detent. When this event occurs, the drive gear rotates freely about the metering assembly thereby allowing the individual torsion springs 228 to return the metering assembly to the first, partially occluding position 229A. Upon return to the first, partially occluding position, the springs 340 expand thereby urging the pawl 341 back into mating receipt in the detent.

As previously discussed herein, and as best seen by reference to FIGS. 3, 4, 5, 6 and 8, the carriage assembly 180 is operable for limited travel along a path of travel 181A which is substantially coaxially aligned relative to the major axis 81A. As should be understood, reciprocal movement imparted to the carriage assembly by way of force applied to the forward support assembly 111, has the effect of varying the tension of the drive chains 232 and 233, respectively. To accommodate this fluctuating tension, the apparatus includes first and second tensioning assemblies 350A, and 350B, and which are individually operable to maintain a constant tension on the first and second drive chains 232 and 233 regardless of the position of the carriage assembly. Each tensioning assembly includes a support member 351 which is positioned in the operating cavity 101 and which may be fixed on or otherwise made integral with the bottom surface 91B of the platform 80. Mounted on the support member is a tensioning adjustment bar 352 which includes a first end 353 and an opposite second end 354. The first end 353 is pivotally mounted on the support member by means of a pin or the like (not shown). During operation, the bar reciprocally pivots about the pin in a direction which is generally parallel to the major axis 81A. First and second sprockets 355 and 356, respectively, are individually, rotatably mounted on the tensioning adjustment bar. The first sprocket is mounted on the first end, and the second sprocket is mounted on the second end 354. The first and second sprockets are idler sprockets which matingly engage the respective drive chains. A spring 357 having a first end 358 and a second end 359 is operable to bias the second end of the tensioning bar in a clockwise direction a that is viewed in FIG. 5. As should be understood, the first end of the spring is mounted on the support member in a predetermined location and the second end of the spring is mounted or fastened on the second end of the tensioning adjustment bar.

In operation, and in the situation wherein the forward support assembly 121 and the carriage assembly 180 are moved forward in the housing 13 toward the transparent panel 4 thereby positioning or sandwiching a relatively thin newspaper 11 against the display assembly 37 for viewing from a position outside the housing 13, the respective drive chains 232 and 233 are elongated thereby further pivoting the tensioning adjustment bar rearwardly or in counter-clockwise directions as that is viewed in FIG. 5. Conversely, and if the forward support assembly and the carriage assembly are moved rearwardly of the housing, and in a direction away from the transparent panel to position a relatively thick newspaper in sandwiched relation between the display assembly 37 of the support assembly, tension is maintained upon the respective drive chains by the spring 357 which urges the tensioning adjustment bar forwardly or in a clockwise direction and which, in turn, maintains the tension on the respective drive chains. Further, this movement of the carriage 180 places the metering assembly in the approximately precise location, relative to the platform aperture 85 to vend a newspaper having the approximate thickness dimension of the newspaper which is placed between the display assembly 37 and the forward support assembly 111. Thus, the apparatus 10 automatically adjusts for newspapers 11 having different thickness dimensions merely by replacing the newspaper 11 with the edition which is now being loaded into the housing 13.

OPERATION

The operation of the described embodiment of the present invention is believed to be readily apparent and is briefly summarized at this point.

The apparatus 10 of the subject invention is operable to sequentially vend a plurality of newspapers 11 or similarly shaped objects, or articles to consumers. As should be understood, the dispensing apparatus for vending articles includes a housing 13 which encloses the articles to be vended, such as newspapers 11 or the like, the housing having a passageway 45 formed therein through which the individual articles may exit or pass from the housing during a successful vending cycle. A platform 80 is borne by the housing and is operable to support the articles within the housing. A rearward support assembly 112 is borne by the platform and is operable to urge the articles towards the passageway. A forward support assembly 111 is slideably borne by the platform and is operable to position an article in an appropriate orientation for viewing from a location outside the housing. A carriage assembly 180 is borne by the forward support assembly, and movement of the forward support assembly locates the carriage assembly in a predetermined position relative to the platform. A metering assembly, and which is generally indicated by the numeral 210, is pivotally mounted on the carriage assembly and operable for movement from a first position 229A, wherein the metering assembly substantially inhibits movement of the newspapers toward the passageway, to a second position 229B, wherein the metering assembly permits the articles to move towards the passageway. As earlier discussed, the positioning of the newspapers between the forward support assembly and the display assembly 37 causes the metering assembly to be located in a position whereby it may vend newspapers having the same thickness dimension as the one being displayed. An actuator 150 is rotatably mounted on the housing. Finally, a drive assembly and which is generally indicated by the numeral 240, is disposed in force receiving relation relative to the actuator and in driving relation relative to the metering assembly and rearward support assembly, respectively. The drive assembly is operable to simultaneously urge the rearward support assembly toward the passageway, and drive the metering assembly from the first position, to the second position. As should be understood, movement of the actuator causes a single newspaper to vend from the apparatus 10.

In order to place the apparatus 10 in operation, the newspapers 11 to be vended for that particular day are placed in the apparatus by slideably moving the apparatus 10 out of the housing 13. As noted above, the current edition of the newspaper to be dispensed will be placed between the display assembly 37, and the forward support assembly 111. When this event occurs, the carriage assembly 180 is automatically positioned in an appropriate location relative to the platform 80 thereby adjusting the apparatus 10 for the current newspaper edition. As should be understood, the display assembly is borne by the housing, and permits access to the housing thereby facilitating maintenance of the apparatus, as well as resupply of the various newspapers vended by same.

As should be understood, the rearward support assembly 112 is slideably borne on the platform 80 and is operable for movement along a first path of travel which coincides with the path of travel 112A. As earlier discussed, the rearward support assembly urges the stack of newspapers 11 towards the passageway 45. Further, the carriage assembly 180 and which is mounted on the forward support assembly, is disposed between the housing 13 and the platform 80 and is operable for limited movement along a second path of travel which coincides with the path of travel 181A. As noted above, the placement of a single newspaper 11 in sandwiched relation between the display assembly 37 and the forward support assembly 111, locates the carriage assembly in a position relative to the platform 80 to vend newspapers of substantially identical thickness dimensions.

The forward support assembly 111, as discussed earlier, is biased in the direction of the display assembly 37. Further, the forward support assembly is operable to position a single newspaper 11 against the display assembly for viewing from a position outside the housing. As noted earlier, the metering assembly 210 is mounted for pivotable movement on the carriage assembly 180 and is operable for movement along a third path of travel which substantially coincides with the path of travel 210A from a first position 229A, wherein the metering assembly is disposed in partially occluding relation relative to the aperture 85, thereby substantially inhibiting forward movement of the newspapers 11 towards the passageway 45, to a second position 229B, wherein the metering assembly is disposed in a substantially non-occluding position relative to the aperture thereby permitting the newspapers to move towards the passageway. As should be understood, individual torsion springs 228 are borne by the carriage assembly 180 and are operable to bias the metering assembly in the direction of the first, occluding position.

The actuator 150, acting in combination with the drive assembly 240, are operable to cause the newspapers 11 to move along the platform 80. In particular, the actuator 150 is rotatably mounted on the housing 13 and is operable for movement along a fourth path of travel which substantially coincides with the path of travel 150A. The actuator is moveable from a first, non-vend position 151A, to a second, vend position 151B. The actuator includes a handle portion 152 upon which force is applied by a customer, and a drive portion 153.

A drive assembly 240 is disposed in force receiving relation relative to the actuator 150, and in driving relation relative to the rearward support assembly 112, and the metering assembly 210, respectively. The drive assembly is operable to simultaneously drive the rearward support assembly 112 along the first path of travel 112A, toward the passageway 45, and drive the metering assembly 210 along the third path of travel 210A from the first partially occluding position 229A, to the second, non-occluding position 229B. The drive assembly further includes first and second axle assemblies 241 and 242, respectively, which are rotatably borne by the platform 80 and are disposed in predetermined parallel, space relation, one to the other. Each of the axle assemblies further have opposite first and second ends. First and second sprockets which are represented by the sprockets 291 and 307, respectively, are individually mounted, and substantially coaxial aligned, one to the other, on the first end of each of the axle assemblies. A first drive chain which is represented by the drive chain 294, is disposed in driving relation about the first and second sprockets. The rear support assembly 112 is fixed on the first drive chain. In addition, a drive gear including a ratchet and pawl assembly 245 are mounted on the first end of the first axle assembly and are disposed in force receiving relation relative to the actuator 150. As noted earlier, movement of the actuator from the first non-vend position 151A to a second, vend position 151B imparts rotational movement to the first axle assembly by means of the ratchet and pawl assembly 247, thereby urging the rear support assembly toward the passageway 45. In addition, a third sprocket which is represented by the metering drive sprocket 311, and a drive clutch 230 are individually mounted in substantially coaxial alignment, one to the other on the second axle assembly and the metering assembly 210, respectively. As should be understood, a second drive chain, which is represented by the drive chain 232, is disposed in driving relation about the third sprocket and drive clutch, respectively, and motion of the actuator 150, from the first, non-vend position 151A, to the second, vend position 151B, imparts rotational movement to the second axle assembly thereby causing force to be transmitted through the second drive chain to the drive clutch. When this event occurs, the clutch urges the metering assembly 210 to move from the first, partially occluding position 229A to the second, non-occluding position 229B. In addition, movement of the actuator from the second, vend position to the first, non-vend position imparts no rotational movement to the first axel assembly but permits the metering assembly under the influence of the respective torsion springs 228, to return from the second, non-occluding position to the first, partially occluding position, thereby completing a single vending cycle.

As discussed earlier, to initiate a vending cycle, appropriate coinage would need to be inserted in a state-of-the-art coin deposit assembly 66, thereby permitting the actuator to move along path of travel 150A. The coin deposit assembly, however, does not constitute an integral part of the present invention but is well understood by those skilled in the art.

Therefore, the apparatus 10 of the subject invention can be employed in a wide variety of operative environments, can be manufactured and purchased at moderate costs when compared with related prior art devices, is highly efficient in operation and is compact, thereby facilitating its utilization and maintenance, and is further designed in a fashion whereby it reduces to an absolute minimum the assorted problems associated with many of the prior art devices which are designed for substantially identical purposes.

Although the present invention has been shown herein and described in what is conceived to be the most practical and preferred embodiment, it is recognized that departures may be made therefrom within the scope of the invention which is not to be limited to the illustrative details disclosed.

Having described my invention, what I claim as new and desire to secure by Letters Patent is:

1. A dispensing apparatus for vending articles comprising:

a platform having a forward portion and operable to support the articles to be vended;

a rearward support assembly slideably borne by the platform and operable to urge the articles toward the forward portion of the platform;

a carriage assembly moveably borne by the platform;

a metering assembly pivotally mounted on the carriage assembly and operable for movement from a first position, wherein the metering assembly substantially inhibits movement of the articles toward the forward portion of the platform, to a second position, wherein the metering assembly permits the articles to move toward the forward portion of the platform;

an actuator disposed in force transmitting relation relative to the platform; and a drive assembly borne by the platform and disposed in force receiving relation relative to the actuator, and in driving relation relative to the rearward support assembly, and the metering assembly, respectively, the drive assembly simultaneously urging the rearward support assembly toward the forward portion of the platform, and driving the metering assembly from the first position to the second position, upon movement of the actuator, thereby vending a single article.

2. A dispensing apparatus, as claimed in claim 1, and wherein the platform is enclosed within a housing which includes a display assembly, and wherein a forward support assembly is slideably borne by the platform and the carriage assembly is mounted on the forward support assembly, and wherein the forward support assembly and the display assembly positions one of the articles in an orientation where it may be viewed from a position outside the housing, the article sandwiched between the display assembly and the forward support assembly, and wherein the forward support assembly positions the metering assembly in a location relative to the platform which is appropriate to meter articles having approximately similar dimensions.

3. A dispensing apparatus, as claimed in claim 2, and wherein the apparatus further includes a support member which positions the housing in angled relation relative to the surface of the earth.

4. A dispensing apparatus, as claimed in claim 3, and wherein the forward support assembly is biased in a direction towards the display assembly thereby supporting the article against the display assembly for viewing from a location outside the housing.

5. A dispensing apparatus, as claimed in claim 4, and wherein the drive assembly further includes a belt which is operable to frictionally engage the individual articles, thereby urging the articles toward the forward portion of the platform.

6. A dispensing apparatus for sequentially vending articles such as newspapers and other similarly shaped objects, comprising:

a housing which defines a cavity, and which encloses a plurality of newspapers, the housing further including a passageway through which the individual newspapers may pass;

a display assembly borne by the housing;

a platform borne by the housing and disposed within the cavity, the platform including a major axis, and a minor axis which is oriented substantially perpendicular relative thereto, the platform further defining an aperture, and wherein the platform is operable for supporting the newspapers within the housing;

a rearward support assembly borne by the platform and oriented in substantially parallel relation relative to the minor axis, the rearward support assembly moveable along a first path of travel which is substantially coaxially aligned relative to the major axis, the rearward support assembly operable to urge the individual newspapers toward the passageway;

a forward support assembly borne by the housing and slideably moveable relative to the display assembly, the forward support assembly operable to support a newspaper against the display assembly for viewing from a position outside the housing;

a carriage assembly mounted on the forward support assembly and which is operable for movement along a second path of travel which is substantially parallel to the major axis, and wherein the positioning of a single newspaper in supported relation against the display assembly locates the carriage assembly in a predetermined position along the second path of travel;

a metering assembly mounted on the carriage assembly and which is operable for movement along a third path of travel from a first position, wherein, the metering assembly is disposed in partially occluding relation relative to the aperture thereby substantially inhibiting forward movement of the newspapers toward the passageway, to a second position, wherein, the metering assembly is disposed in a substantially non-occluding position relative to the aperture thereby permitting the newspapers to move toward the passageway;

an actuator mounted on the housing and which is operable for movement along a fourth path of travel from a first, non-vend position to a second, vend position; and a drive assembly borne by the platform and disposed in force receiving relation relative to the actuator, and in driving relation relative to the rearward support assembly and metering assembly, respectively, the drive assembly operable, substantially simultaneously, to urge the rearward support assembly along the first path of travel toward the passageway, and drive the metering assembly along the third path of travel from the first, partially occluding position to the second, substantially non-occluding position, when the actuator is moved from the first, non-vend position to the second, vend position thereby causing a single newspaper to pass from the housing through the passageway.

7. A dispensing apparatus as claimed in claim 6, and wherein the drive assembly includes first and second axle assemblies which are individually borne by the platform and disposed in predetermined, parallel, spaced relation one to the other, and wherein the axle assemblies further have opposite first and second ends, and wherein first and second sprockets are individually mounted on the first end of each of the axle assemblies, and wherein a first drive chain is disposed in driving relation about the first and second sprockets, and wherein the rearward support assembly is fixed on the first drive chain, and wherein further, a drive gear, including a ratchet and pawl assembly are mounted on the first end of the first axle assembly and are disposed in force receiving relation relative to the actuator, and wherein movement of the actuator from the first, non-vend position to the second, vend position imparts rotational movement to the first and second axle assemblies by means of the ratchet and pawl assembly thereby urging the rearward support assembly toward the passageway, and wherein a third sprocket and a drive clutch are individually mounted on the second axle assembly and metering assembly respectively, and wherein a second drive chain is disposed in driving relation about the third sprocket and drive clutch, and wherein motion of the actuator from the first, non-vend position to the second, vend position imparts rotational movement to the first and second axle assemblies thereby causing force to be transmitted through the second drive chain to the drive clutch, the drive clutch urging the metering assembly to move from the first, partially occluding position to the second, non-occluding position, and wherein movement of the actuator from the second, vend position, to the first non-vend position imparts no rotational movement to the first axle assembly thereby permitting the metering assembly to return from the second, non-occluding position, to the first, partially occluding position under the influence of a torsion spring.

8. An apparatus as claimed in claim 7, and wherein the torsion spring is borne by the carriage assembly and is operable to urge the metering assembly from the second non-occluding position to the first, partially occluding position.

9. An apparatus as claimed in claim 8, and wherein the actuator is operable when located in the first, non-vend position to substantially occlude the passageway of the housing, and wherein the actuator further includes a drive portion which matingly and drivingly engages the drive gear.

10. A dispensing apparatus as claimed in claim 9, and wherein first and second belt pullies are individually mounted on each of the first and second axle assemblies, respectively, and wherein a continuous belt, having an upper course, is disposed in driving relation about the respective belt pullies, and wherein the upper course is disposed in a predetermined position relative to the platform such that the upper course frictionally engages the respective newspapers, and wherein movement of the actuator from the first, non-vend position to the second, vend position causes the first and second axle assemblies to rotate thereby simultaneously causing the upper course to frictionally urge the respective newspapers along the platform toward the passageway.

11. A dispensing apparatus as claimed in claim 10 and wherein the housing includes a support beam which guides and supports the forward and rearward support assemblies for movement relative to the platform; and wherein the housing further includes a tensioning assembly which matingly engages the second drive chain and which maintains a substantially constant tension on the chain regardless of the position of the carriage assembly.

12. A dispensing apparatus for sequentially vending a plurality of newspapers, and the like comprising:

a housing defining a cavity and which encloses a plurality of newspapers and wherein the newspapers are individually defined by respective length, width, and thickness dimensions, and wherein the housing further defines a passageway which permits individual newspapers to pass from the housing, the passageway having a length dimension which is greater than the width of the individual newspapers, and a width dimension which is greater than the thickness dimension of the individual newspapers;

a display assembly borne by the housing;

a platform borne by the housing and disposed within the cavity, the platform including a top surface and a bottom surface, the platform further including a major axis, and a minor axis which is oriented perpendicular thereto, the platform having an aperture formed therein which is oriented substantially coaxially relative to the minor axis, the platform operable to support the plurality of newspapers;

a rearward support assembly slideably borne on the platform, and oriented in substantially parallel relationship relative to the minor axis, the rearward support assembly mounted for movement along a first path of travel which is substantially coaxially aligned relative to the major axis, the rearward support assembly operable to urge the stack of newspapers toward the passageway;

a forward support assembly moveably mounted on the platform and biased in the direction of the display assembly, the forward support assembly operable to hold one newspaper against the display assembly for viewing from a position outside the housing;

a carriage assembly, including a torsion spring, mounted on the forward support assembly and operable for limited movement along a second path of travel which is substantially coaxially oriented relative to the major axis, and wherein the placement of one newspaper in sandwiched relation between the display assembly and the forward support assembly locates the carriage assembly in a predetermined position along the second path of travel;

a metering assembly mounted for pivotal movement on the carriage assembly and operable for movement along a third path of travel from a first position, wherein the metering assembly is disposed in partially occluding relation relative to the aperture, thereby substantially inhibiting forward movement of the newspapers toward the passageway, to a second position, wherein the metering assembly is disposed in a substantially non-occluding position relative to the aperture thereby permitting the newspapers to move toward the passageway, and wherein the torsion spring is operable to bias the metering assembly in the direction of the first, occluding position;

an actuator rotatably mounted on the housing, and operable for movement along a fourth path of travel from a first non-vend position to a second, vend position, the actuator including a handle, and a drive portion; and a drive assembly borne by the platform and disposed in force receiving relation relative to the actuator, and in driving relation relative to the rearward support assembly, and metering assembly, respectively, and wherein the drive assembly is operable to simultaneously drive the rearward support assembly along the first path of travel toward the passageway, and drive the metering assembly along the third path of travel from the first, partially occluding position, to the second, non-occluding position, and wherein the drive assembly includes first and second axle assemblies which are borne by platform and disposed in predetermined, parallel, spaced relation one to the other, and wherein the axle assemblies further have opposite first and second ends, and wherein first and second sprockets are individually mounted on the first end of each of the axle assemblies, and wherein a first drive chain is disposed in driving relation about the first and second sprockets, and wherein the rearward support assembly is fixed on the first drive chain, and wherein further, a drive gear including a ratchet and pawl assembly are mounted on the first end of the first axle assembly and are disposed in force receiving relation relative to the actuator, and wherein movement of the actuator from the first, non-vend position to the second, vend position imparts rotational movement to the first axle assembly by means of the ratchet and pawl assembly thereby urging the rearward support assembly toward the passageway, and wherein a third sprocket and a drive clutch are individually mounted on the second axle assembly and metering assembly respectively, and wherein a second drive chain is disposed in driving relation about the third sprocket and drive clutch, and wherein motion of the actuator from the first, non-vend position to the second, vend position imparts rotational movement to the second axle assembly thereby causing force to be transmitted through the second drive chain to the drive clutch thereby causing the drive clutch to urge the metering assembly to move from the first, partially occluding position, to the second, non-occluding position, and wherein movement of the actuator from the second, vend position, to the first, non-vend position imparts no rotational movement to the first axle assembly thereby permitting the metering assembly to return from the second, non-occluding position, to the first, partially occluding position under the influence of the torsion spring.

* * * * *